United States Patent [19]

Edwards, Jr. et al.

[11] Patent Number: 5,047,601

[45] Date of Patent: Sep. 10, 1991

[54] PRESSURE RESPONSIVE SWITCH WITH CUP SHAPED ACTUATING MEMBER

[75] Inventors: Stanley H. Edwards, Jr., Raleigh; Dwight D. Edwards, Asheville; James B. Warren, Arden; Jackie C. Sullivan, Wendell, all of N.C.

[73] Assignee: Square D Company, Palatine, Ill.

[21] Appl. No.: 470,026

[22] Filed: Jan. 25, 1990

[51] Int. Cl.[5] ..... H01H 35/24

[52] U.S. Cl. ..... 200/81 R; 200/82 R

[58] Field of Search ..... 200/81 R, 82 R, 83 R, 200/82 A, 83 P, 83 S, 83 SA, 83 Z

[56] References Cited

U.S. PATENT DOCUMENTS

| | | | |
|---|---|---|---|
| 2,334,443 | 11/1943 | Schubert | 200/61.25 |
| 2,949,098 | 8/1960 | Flick | 92/110 |
| 3,007,624 | 11/1961 | Netzel | 417/85 |
| 3,031,548 | 4/1962 | Robinson | 200/81 R |
| 3,112,382 | 11/1963 | Baker | 200/82 R |
| 3,275,769 | 9/1966 | Weaver | 200/82 R |
| 3,301,977 | 1/1967 | Simonin, Jr. | 200/82 R |
| 3,487,185 | 12/1969 | Schweizer | 200/82 R |
| 3,546,667 | 12/1970 | Thomas | 340/452 |
| 3,773,991 | 11/1973 | Krieger et al. | 200/83 Z X |
| 4,229,629 | 10/1980 | Pawlowski | 200/82 R |
| 4,384,183 | 5/1983 | Meshoulam | 200/82 R |
| 4,709,126 | 11/1987 | Miller et al. | 200/83 P |
| 4,724,289 | 2/1988 | Heissler | 200/82 R |

*Primary Examiner*—J. R. Scott

*Attorney, Agent, or Firm*—David R. Stacey; David R. Price

[57] ABSTRACT

A pressure responsive switch apparatus comprising a housing including a wall defining a passageway having an end adapted to communicate with a source of fluid under pressure, a switch supported by the housing, an actuator which is movably supported by the housing and which includes an end extending into the passageway, an actuator for actuating the switch in response to movement of the actuator, and a cup-shaped member detached from the actuator and located within the passageway and between the actuator and the end of the passageway for sealingly engaging the wall and moving the actuator away from the end of the passageway in response to pressure from the fluid source.

30 Claims, 3 Drawing Sheets

PRESSURE RESPONSIVE SWITCH WITH CUP SHAPED ACTUATING MEMBER

BACKGROUND OF THE INVENTION

The invention relates to pressure responsive electrical switch apparatus. An example of such apparatus is disclosed in U.S. Pat. No. 3,824,358, which is assigned to the assignee hereof.

Pressure responsive switch apparatus are used, for example, to control the electric motor of an air compressor that supplies compressed air to a reservoir. The pressure responsive switch apparatus communicates with the reservoir and shuts off the electric motor when the pressure in the reservoir is above a predetermined level.

A typical pressure responsive switch apparatus includes a housing, a switch supported by the housing and connected to the electric motor or other controlled device, an actuator movably supported by the housing and operably connected to the switch, and means such as a flexible diaphragm for causing movement of the actuator in response to pressure from the reservoir or other source of pressure.

Attention is directed to the following U.S. Pat. Nos.:

| | | |
|---|---|---|
| 2,334,443 | 3,275,769 | 4,384,183 |
| 2,949,098 | 3,301,977 | 4,709,126 |
| 3,007,624 | 3,487,185 | 4,724,289 |
| 3,031,548 | 3,546,667 | |
| 3,112,382 | 4,229,629 | |

SUMMARY OF THE INVENTION

The invention provides a pressure responsive switch including an improved arrangement for causing movement of the switch actuator in response to pressure from a pressure source. The arrangement provided by the invention is both less expensive to manufacture and easier to assemble than known prior art arrangements.

The invention also provides a pressure responsive switch including an improved arrangement for connecting electrical cables to the switch housing. More particularly, the arrangement provided by the invention accommodates the different sized electrical cables that may be required by different electrical codes. For example, Canada requires a more heavily insulated power supply cable than is required in the United States.

More particularly, the invention provides a pressure responsive switch apparatus comprising a housing including a wall defining a passageway having a longitudinal axis and an end adapted to communicate with a source of fluid under pressure. The apparatus also comprises a switch supported by the housing, and an actuator which is movably supported by the housing and which includes an end extending into the passageway. The apparatus further comprises means for actuating the switch in response to movement of the actuator, and a cup-shaped member which is detached from the actuator, which is located within the passageway and between the actuator and the end of the passageway, and which opens toward the end of the passageway. The cup-shaped member includes an end wall extending generally perpendicular to the axis, and an endless, outwardly flared side wall extending from the end wall toward the end of the passageway.

Preferably, the passageway has a generally circular cross section and an inner diameter, the end wall of the cup-shaped member is generally circular and has an outer diameter less than the inner diameter, and the side wall of the cup-shaped member is annular and has a maximum outer diameter substantially equal to the inner diameter.

Because the cup-shaped member is detached from the actuator, it is not necessary to have the actuator precisely aligned with the passageway even though the cup-shaped member is precisely aligned with the passageway. In other words, the actuator can move laterally with respect to the cup-shaped member and can be separated from the cup-shaped member. Thus, having a separate cup-shaped member avoids stacking up tolerances. This also simplifies assembly of the switch apparatus because the cup-shaped member and the actuator do not have to be positioned relative to the housing at the same time.

The apparatus also comprises a plurality of electrical terminals supported by the housing, a pair of electrical cables each connected to at least one of the terminals, and means for securing the cables to the housing and for permitting the cables to have equal or different cross-sectional areas.

Preferably, the securing means includes a clamping member having a side facing the housing and engaging the cables, and means for securing the clamping member against the cables so that the cables are clamped between the clamping member and the housing. Furthermore, in the preferred embodiment, the clamping member has therein an elongated slot having a length and a width, and the means for securing the clamping member includes a screw extending through the slot and between the cables and including a head having a width greater than the width of the slot and less than the length of the slot, and a shank which extends through the slot, which is secured to the housing, and which has a width less than the length of the slot.

Because the length of the slot is greater than the width of the shank, the clamping member can be cocked relative to the screw. This is necessary if one of the cables has a thickness greater than the thickness of the other cable. If the cables have equal thicknesses, the clamping member is not cocked relative to the screw but extends generally perpendicular to the screw.

Other features and advantages of the invention will become apparent to those skilled in the art upon review of the following detailed description, claims and drawings.

Figure 1:
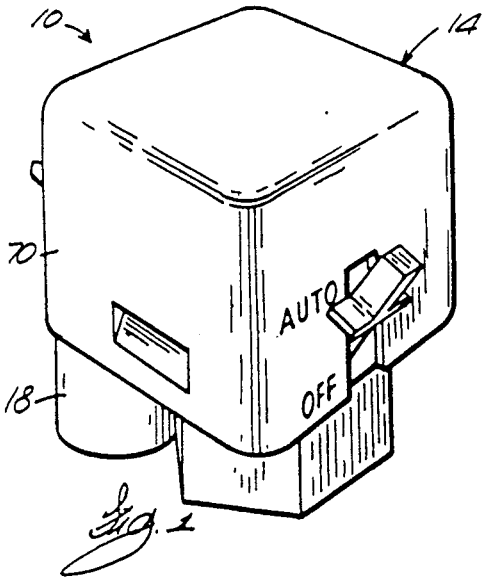
FIG. 1 is a perspective view of a switch apparatus embodying the invention and including mating housing sections and a cover member.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A pressure responsive switch apparatus 10 embodying the invention is illustrated in the drawings.

Figure 2:
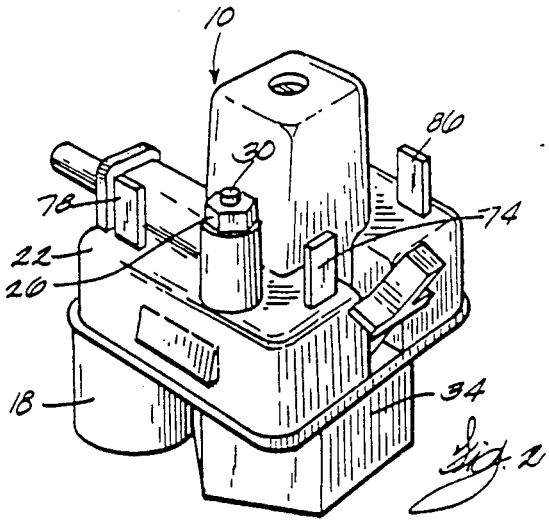
FIG. 2 is a perspective view of the apparatus with the cover member removed.
Figure 4:
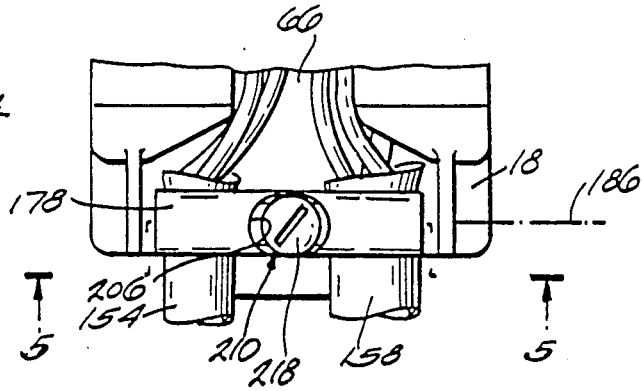
FIG. 4 is a partial elevational view of the apparatus as shown in FIG. 3.
Figure 5:
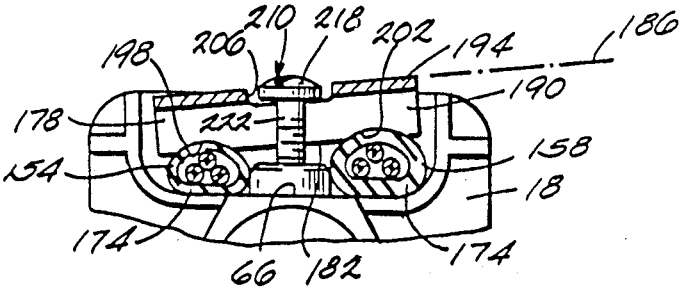
FIG. 5 is a view taken along line 5—5 in FIG. 4.
Figure 9:
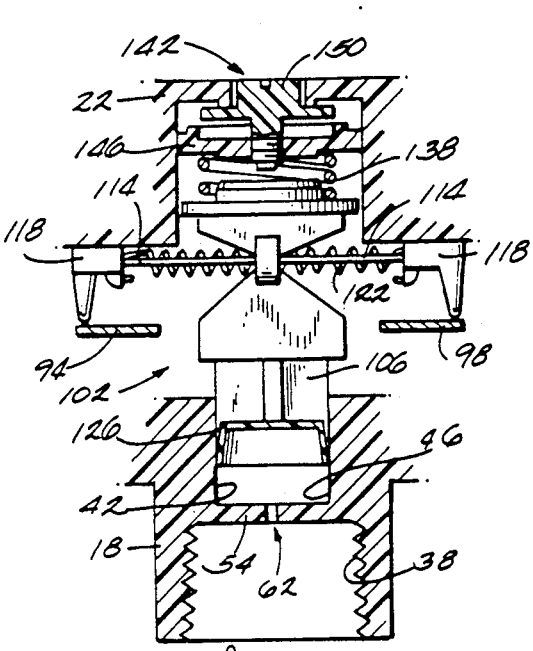
FIGS. 8–10 are partial sectional views of the apparatus illustrating operation thereof.
Figure 10:
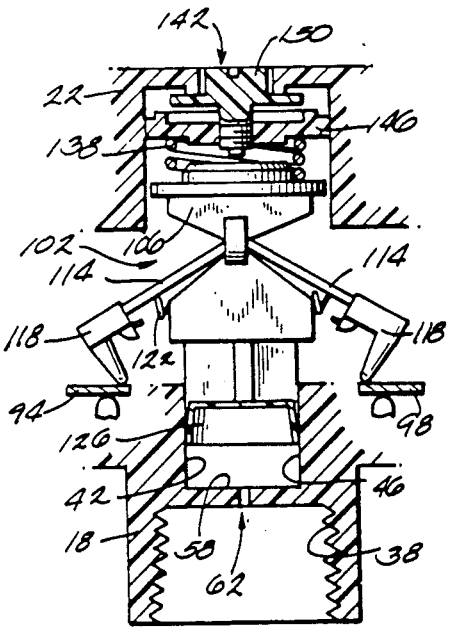

The apparatus 10 comprises a housing 14 including housing sections 18 and 22 fixed to each other by suitable means such as nuts 26 and bolts 30 (FIG. 2). The housing section 18 has thereon a hexagonal boss 34 having therein (see FIGS. 8–10) an internally threaded bore 38 adapted to communicate with a source of fluid under pressure (not shown). The housing section 18 also includes (see FIGS. 8–10) an interior wall 42 defining a generally circular passageway 46 having an inner diameter and a longitudinal axis 50 (FIG. 8), and a wall 54 (FIGS. 8 and 9) separating the bore 38 and the passageway 46, defining an end 58 (FIG. 10) of the passageway 46 and having therein a pressure port 62 communicating between the bore 38 and the passageway 46. The housing section 18 also includes an exterior wall 66 (FIGS. 4 and 5). The housing 14 also includes (see FIG. 1) a cover member 70 removably fastened to the housing section 22 in order to shield the below-described electrical terminals.

Figure 6:
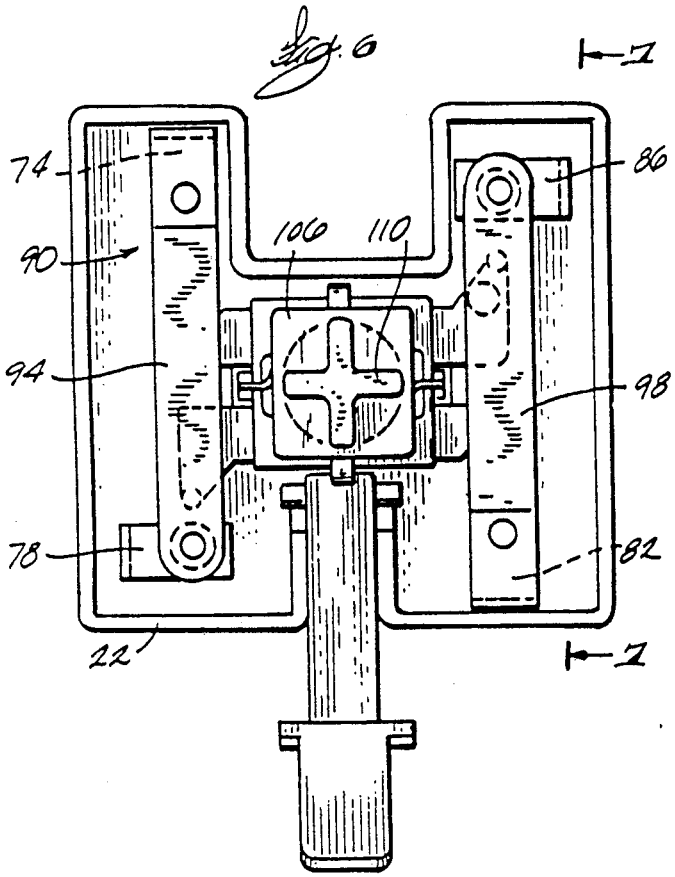
FIG. 6 is a plan view of one of the housing sections and associated elements of the apparatus.
Figure 7:
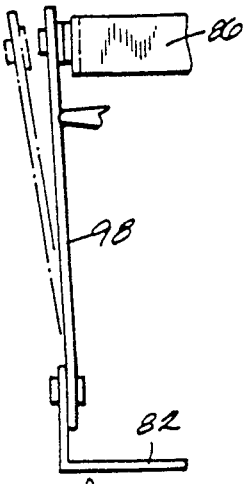
FIG. 7 is a view taken along line 7—7 in FIG. 6.
Figure 3:
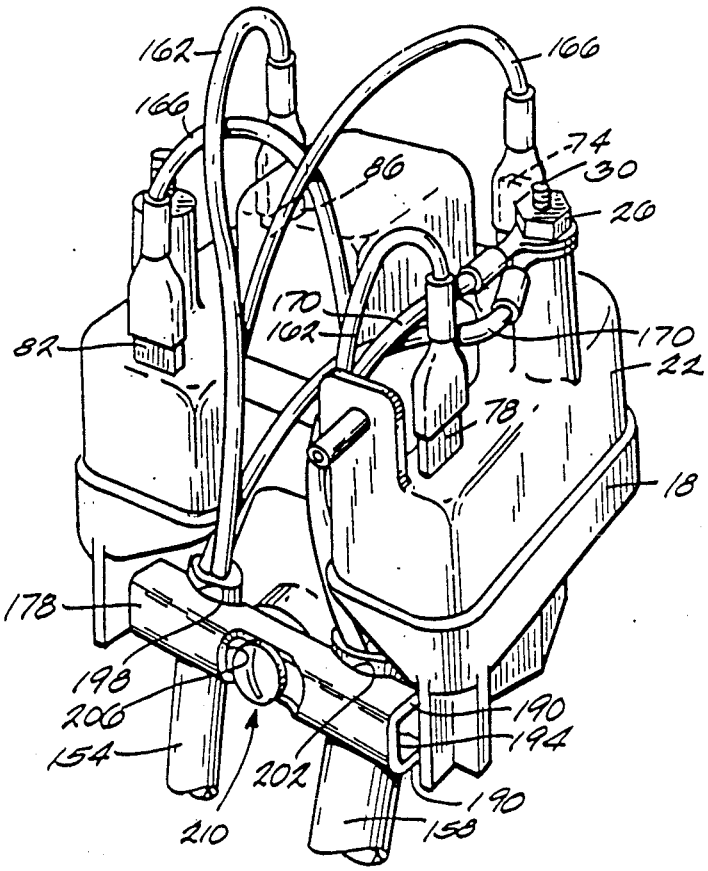
FIG. 3 is a perspective view of the apparatus as shown in FIG. 2 but with a different orientation.

The apparatus 10 also comprises (see FIGS. 2, 3 and 6) four electrical terminals 74, 78, 82 and 86 supported by the housing section 22, and a switch 90 (FIG. 6) supported by the housing section 22. While various suitable switches can be employed, in the preferred embodiment, the switch 90 includes (see FIGS. 6–10) a movable contact blade 94 having one end fixed to the terminal 74 and an opposite end movable into and out of engagement with the terminal 78. The switch 90 also includes a movable contact blade 98 having one end fixed to the terminal 82 and an opposite end movable into and out of engagement with the terminal 86. Thus, the terminals 74 and 82 constitute fixed or stationary contacts. The contact blades 94 and 98 are biased into engagement with the fixed contacts 74 and 82.

Figure 8:
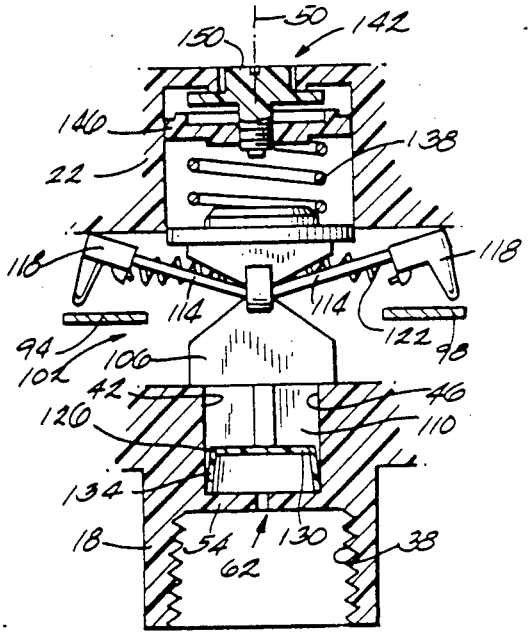

The apparatus 10 also comprises means for moving the movable contacts 94 and 98 into and out of engagement with the fixed contacts 74 and 82. While various suitable means can be employed, in the illustrated construction, such means includes (see FIGS. 8–10) an over-center mechanism 102. The over-center mechanism 102 includes an actuator 106 supported by the housing for movement along the passageway axis 50. As shown in FIG. 8, the actuator 106 includes an end 110 extending into the passageway 46. The over-center mechanism 102 also includes a pair of flippers 114 pivotally supported by the actuator 106, an insulating member 118 on the end of each flipper 114, and a spring 122 which extends between the flippers 114 and which biases the flippers 114 away from their center position, i.e., away from the position in which the flippers 114 are coplanar. The flippers 114, the insulating members 118 and the spring 122 constitute means for actuating the switch 90 in response to movement of the actuator 106.

The apparatus 10 also comprises means detached from the actuator 106 and located within the passageway 46 and between the actuator 106 and the end 58 of the passageway 46 for sealingly engaging the wall 42 in response to pressure from the fluid source and for moving the actuator 106 away from the end 58 of the passageway 46 and in the direction of the axis 50 in response to pressure from the fluid source. While various suitable means can be employed, in the preferred embodiment, such means includes (see FIGS. 8–10) a cup-shaped member 126 opening toward the end 58 of the passageway 46. The member 126 includes (see FIG. 8) a generally circular end wall 130 having an outer diameter less than the inner diameter of the passageway 46. The member 126 also includes (see FIG. 8) an endless, annular, outwardly flared side wall 134 extending from the end wall 130 and toward the end 58 of the passageway 46 and having a maximum outer diameter substantially equal to the inner diameter of the passageway 46. The side wall 134 is somewhat flexible so that pressure from the pressure source forces the side wall 134 outwardly and against the passageway wall 42 so that the side wall 134 sealingly engages the wall 42. It should be noted that the side wall 134 engages the passageway wall 42 in the absence of pressure from the fluid source, and this engagement may to some extent be a "sealing" engagement. Nonetheless, pressure from the fluid source forces the side wall 134 against the passageway wall 42 and thereby strengthens the seal between the member 126 and the wall 42. It should also be noted that the side wall 134, which engages the passageway wall 42, is movable relative thereto. Thus, the member 126 differs from a diaphragm. Pressure from the pressure source also exerts a force on the member 126 tending to move the member 126 and thus the actuator 106 away from the end 58 of the passageway 46. The member 126 is detached from the actuator 106 so that the actuator 106 and the member 126 can be separated in the direction of the axis 50 and so that the actuator 106 can move laterally of the passageway 46 with respect to the member 126.

The apparatus 10 also comprises means for biasing the actuator 106 toward the end 58 of the passageway 46 or against the force exerted on the member 126 by the pressure source. While various suitable means can be used, in the illustrated construction, such means includes (see FIGS. 8–10) a range spring 138, and an adjuster assembly 142 for adjusting the force of the spring 138 and therefore for adjusting the fluid pressure necessary to move the actuator 106 away from the end 58 of the passageway 46. The adjuster assembly 142 includes a spring adjuster or member 146 which is supported by the housing 14 for reciprocal movement relative thereto along the axis 50 and which is supported by the housing 14 so as to prevent rotation of the member 146 relative to the housing 14. The adjuster assembly 142 also includes an adjusting screw 150 which threadedly engages the member 146 such that rotation of the screw 150 relative to the member 146 causes axial movement of the member 146 relative to the housing 14 and thereby adjusts the position of the outer end of the range spring 138 relative to the housing 14. Therefore, rotation of the screw 150 adjusts the pressure necessary to move the actuator 106 away from the end 58 of the passageway 46.

The apparatus 10 as thus far described operates as follows. When the actuator 106 is in its lower position, as shown in FIG. 8, the flippers 114 are biased toward their upper positions, and the insulating members 118 rest against the housing 14 and are slightly spaced from the movable contacts 94 and 98. Increasing pressure from the pressure source moves the member 126 and the actuator 106 upwardly, and upward movement of the actuator 106 combined with engagement of the insulating members 118 by the housing 14 moves the flippers 114 toward their center position. When the flippers 114 move over their center position (see FIG. 9), the spring 122 snaps the flippers 114 toward their lower position (see FIG. 10), and engagement of the movable contacts 94 and 98 by the insulating members 118 moves the movable contacts 94 and 98 out of engagement with the fixed contacts 74 and 82. When the pressure from the pressure source decreases, the actuator 106 moves downwardly under the influence of the range spring 138 until the flippers 114 again pass over center and return to their upper positions. This permits the movable contacts 94 and 98 to return to their closed positions.

The apparatus 10 also comprises (see FIGS. 3–5) generally parallel, elongated, flexible, electrically conductive members or cables 154 and 158. Each cable includes a pair of live wires 162 and 166 and a ground wire 170 surrounded by an insulating sheath 174 (FIG. 5). The live wire 162 of the cable 154 is connected to the terminal 86, the live wire 166 of the cable 154 is connected to the terminal 74, and the ground wire 170 of the cable 154 is connected to a bolt 30. The live wire 162 of the cable 158 is connected to the terminal 78, the live wire 166 of the cable 158 is connected to the terminal 82, and the ground wire 170 of the cable 158 is connected to the bolt 30. The live wires of the cable 154 are also connected to the device being controlled by the switch 90 (such as the above-described air compressor motor), and the live wires of the cable 158 are connected to a source of electric power (not shown). The ground wire 170 of the cable 54 is also connected to the controlled device, and the ground wire 170 of the cable 158 is connected to ground.

The apparatus 10 further comprises (see FIGS. 3–5) means for securing the cables 154 and 158 to the housing 14 and for permitting the cables 154 and 158 to have equal or different cross-sectional areas or thicknesses. While various suitable means can be employed, in the preferred embodiment, such means includes a clamping member 178 having a side 182 (FIG. 5) facing the housing wall 66 and engaging the cables 154 and 158. Preferably, the clamping member 178 has a longitudinal axis 186 (FIG. 4) extending generally perpendicular to the cables 154 and 158, and the clamping member 178 is channel-shaped. More particularly, the clamping member 178 includes (see FIG. 3) a pair of generally parallel, spaced apart side portions 190, and a web portion 194 extending generally perpendicular to and between the side portions 190. The inner ends of the side portions 190 define the side 182 of the clamping member 178. Preferably, the side 182 of the clamping member 178 has therein (see FIGS. 3 and 5) recesses 198 and 202 respectively receiving the cables 154 and 158. The web portion 194 of the clamping member 178 has therein a slot 206 elongated in the direction of the clamping member axis 186.

The means for securing the cables 154 and 158 also includes means for securing the clamping member 178 against the cables 154 and 158 so that the cables are clamped between the clamping member 178 and the housing wall 66. While various suitable means can be used, in the illustrated construction, such means includes (see FIGS. 3–5) a connecting member 210 which extends through the slot 206 and which is secured to the housing section 18. In the preferred embodiment, the connecting member 210 is a bolt or screw including (see FIGS. 4 and 5) a head 218 having a width or diameter greater than the width of the slot 206 and less than the length of the slot 206. The screw 210 also includes (see FIG. 5) a shank 222 which extends through the slot 206, which is secured to the housing section 18, and which has a width less than the length of the slot 206. As shown in FIG. 5, the screw 210 extends generally perpendicular to the housing wall 66 and to the clamping member axis 186. Furthermore, the screw 210 extends between the cables 154 and 158. As shown in FIG. 5, the underside of the head 218 of the screw 210 engages the clamping member 178 so that the clamping member 178 and the cables 154 and 158 are clamped between the head 218 of the screw 210 and the housing wall 66.

As explained previously, the construction of the clamping member 178 permits the clamping member 178 to be cocked relative to the screw 210. Thus, the clamping member 178 and the screw 210 constitute means for securing the cables 154 and 158 to the housing 14 and for permitting the cables 154 and 158 to have equal or different cross-sectional areas. Alternatively stated, the apparatus 10 comprises means for permitting variation of the angle between the screw 210 and the clamping member 178 (or the clamping member axis 186), whereby the cables 154 and 158 can have equal or different thicknesses.

Various features of the invention are set forth in the following claims.

We claim:

1. A pressure responsive switch apparatus comprising a housing including a wall defining a passageway having an end adapted to communicate with a source of fluid under pressure, a switch supported by said housing, an actuator which is movably supported by said housing and which includes an end located in said passageway, means for actuating said switch in response to movement of said actuator, and means detached from said actuator and located within said passageway and between said actuator and said end of said passageway for sealingly engaging said wall in response to pressure from the fluid source and for moving said actuator away from said end of said passageway in response to pressure from the fluid source.

2. Apparatus as set forth in claim 1 wherein said passageway has a longitudinal axis, and wherein said last-mentioned means moves said actuator in the direction of said axis and includes a cup-shaped member opening toward said end of said passageway and including an end wall extending generally perpendicular to said axis, and an endless, outwardly flared side wall extending from said end wall and toward said end of said passageway.

3. Apparatus as set forth in claim 2 wherein said passageway has a generally circular cross section and an inner diameter, wherein said end wall is generally circular and has an outer diameter less than said inner diameter, and wherein said side wall is annular and has a maximum outer diameter substantially equal to said inner diameter.

4. A switch apparatus comprising a housing, a plurality of electrical terminals supported by said housing, first and second elongated, flexible, electrically conductive members each connected to at least one of said terminals, and strain relief means for securing said first and second members to said housing and for permitting said first and second members to have equal or different cross-sectional areas, whereby strain on said connection between said conductive members and said terminals produced by tension applied to said conductive members outboard of said housing is substantially relieved.

5. An apparatus as set forth in claim 4 wherein said means includes a clamping member having a side facing said housing and engaging said first and second members, and means for securing said clamping member against said first and second members so that said members are clamped between said clamping member and said housing.

6. An apparatus as set forth in claim 5 wherein said side of said clamping member has therein first and second recesses respectively receiving said first and second members.

7. An apparatus as set forth in claim 5 wherein said clamping member has therein an elongated slot, and wherein said means for securing said clamping member includes a connecting member extending through said slot.

8. An apparatus as set forth in claim 7 wherein said slot has a width, and wherein said connecting member includes a head having a width greater than the width of said slot, and a shank extending through said slot and being secured to said housing.

9. An apparatus as set forth in claim 8 wherein said slot has a length, and wherein said shank has a width less than the length of said slot.

10. An apparatus as set forth in claim 8 wherein said first and second members are generally parallel, wherein said clamping member has a longitudinal axis extending generally perpendicular to said first and second members, and wherein said slot is elongated in the direction of said axis.

11. An apparatus as set forth in claim 10 wherein said slot has a length greater than the width of said head.

12. An apparatus as set forth in claim 5 wherein said means for securing said clamping means includes a connecting member extending between said first and second members.

13. A pressure responsive switch apparatus comprising a housing including a well defining a passageway having a longitudinal axis and an end adapted to communicate with a source of fluid under pressure, a switch supported by said housing, an actuator which is movably supported by said housing and which includes an end extending into said passageway, means for actuating said switch in response to movement of said actuator, and a cup-shaped member which is located within said passageway and between said actuator and said end of said passageway and which opens toward said end of said passageway and includes an end wall extending generally perpendicular to said axis, and an endless, outwardly flared side wall extending from said end wall toward said end of said passageway.

14. Apparatus as set forth in claim 13 wherein said passageway has a generally circular cross section and an inner diameter, wherein said end wall is generally circular and has an outer diameter less than said inner diameter, and wherein said side wall is annular and has a maximum outer diameter substantially equal to said inner diameter.

15. A switch apparatus comprising a housing, a plurality of electrical terminals supported by said housing, generally parallel first and second elongated, flexible, electrically conductive members each connected to at least one of said terminals, a clamping member having a longitudinal axis extending generally perpendicular to said first and second members, a side facing said housing and engaging said first and second members, and a slot which has a width and a length extending in the direction of said axis, and a connecting member including a head having a width greater than the width of said slot, and a shank which extends through said slot, which is secured to said housing, and which has a width less than the length of said slot.

16. An apparatus as set forth in claim 15 wherein said side of said clamping member has therein first and second recesses respectively receiving said first and second members.

17. An apparatus as set forth in claim 15 wherein said length is greater than the width of said head.

18. An apparatus as set forth in claim 15 wherein said connecting member extends between said first and second members.

19. A switch apparatus comprising a housing including a wall, a plurality of electrical terminals supported by said housing, generally parallel first and second elongated, flexible, electrically conductive members each connected to one of said terminals, a clamping member having a longitudinal axis extending generally parallel to said wall and generally perpendicular to said first and second members, and a side facing said wall and engaging said first and second members, means for securing said clamping member against said first and second members so that said first and second members are clamped between said clamping member and said wall, said means for securing said clamping member including a connecting member extending generally perpendicular to said wall and to said axis, and means for permitting variation of the angle between said connecting member and said axis, whereby said first and second members can have equal or different thicknesses.

20. An apparatus as set forth in claim 19 wherein said side of said clamping member has therein first and second recesses respectively receiving said first and second members.

21. An apparatus as set forth in claim 19 wherein said permitting means includes an elongated slot in said clamping member, and wherein said connecting member extends through said slot.

22. An apparatus as set forth in claim 21 wherein said slot has a width, and wherein said connecting member includes a head having a width greater than the width of said slot, and a shank extending through said slot and being secured to said housing.

23. An apparatus as set forth in claim 22 wherein said shank has a width, and wherein said slot has a length greater than the width of said shank.

24. An apparatus as set forth in claim 22 wherein said slot is elongated in the direction of said axis.

25. An apparatus as set forth in claim 23 wherein said slot has a length greater than the width of said head.

26. An apparatus as set forth in claim 19 wherein said connecting member extends between said first and second members.

27. A pressure responsive switch apparatus comprising a housing including a wall defining a passageway having an end adapted to communicate with a source of fluid under pressure, a switch supported by said housing, an actuator which is movably supported by said housing and which includes an end located in said passageway, means for actuating said switch in response to movement of said actuator, and means for moving said actuator away from said end of said passageway in response to pressure from the fluid source, said moving means being detached from said actuator and located within said passageway and between said actuator and said end of said passageway and including a portion which engages said wall and which is movable relative to said wall.

28. Apparatus as set forth in claim 27 wherein said passageway has a longitudinal axis, and wherein said moving means moves said actuator in the direction of said axis and includes a cup-shaped member opening toward said end of said passageway and including an end wall extending generally perpendicular to said axis, and an endless, outwardly flared side wall extending from said end wall and toward said end of said passageway.

29. Apparatus as set forth in claim 28 wherein said passageway has a generally circular cross section and an inner diameter, wherein said end wall is generally circular and has an outer diameter less than said inner diameter, and wherein said side wall is annular and has a maximum outer diameter substantially equal to said inner diameter.

30. Apparatus as set forth in claim 28 wherein said portion is said side wall.

* * * * *